US011421692B2

(12) United States Patent
Wu et al.

(10) Patent No.: US 11,421,692 B2
(45) Date of Patent: Aug. 23, 2022

(54) WATER PUMP MODULE

(71) Applicant: Delta Electronics, Inc., Taoyuan (TW)

(72) Inventors: Wei-Fang Wu, Taoyuan (TW); Chia-Ying Hsu, Taoyuan (TW); Chia-Yu Yeh, Taoyuan (TW); Chi-Chang Teng, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 16/938,190

(22) Filed: Jul. 24, 2020

(65) Prior Publication Data

US 2021/0025399 A1 Jan. 28, 2021

Related U.S. Application Data

(60) Provisional application No. 62/878,576, filed on Jul. 25, 2019.

(30) Foreign Application Priority Data

Jun. 9, 2020 (CN) ..... 202010516700.1

(51) Int. Cl.
*F04D 13/14* (2006.01)
*F04D 1/06* (2006.01)
(Continued)

(52) U.S. Cl.
CPC ..... *F04D 1/06* (2013.01); *F04D 13/14* (2013.01); *F04D 29/043* (2013.01); *F04D 29/4293* (2013.01)

(58) Field of Classification Search
CPC .... F04D 13/14; F04D 29/4293; F04D 29/043; F04D 1/06
See application file for complete search history.

(56) References Cited

U.S. PATENT DOCUMENTS 1,952,882 A * 3/1934 Morgan ..... B67D 7/70 73/199
2,037,775 A * 4/1936 Fox ..... F04D 15/0072 415/61
(Continued)

FOREIGN PATENT DOCUMENTS

CN 101144482 A 3/2008
CN 204187069 U 3/2015
(Continued)

OTHER PUBLICATIONS

Office Action dated Sep. 2, 2021 of the corresponding China patent application No. 202010507282.X.
(Continued)

*Primary Examiner* — Dominick L Plakkoottam
(74) *Attorney, Agent, or Firm* — Chun-Ming Shih; HDLS IPR Services

(57) ABSTRACT

A pump body includes a housing, a first and a second chambers separated and communicated by the housing, an input pipe communicated with the first chamber and an output pipe communicated with the second chamber. The input pipe has a water outlet located in the first chamber. The output pipe has a water inlet located in the second chamber. The first pump has a first rotor placed in the first chamber. The second pump has a second rotor placed in the second chamber, wherein an extension line of a rotating shaft of the second rotor is perpendicular to a plane where a rotating shaft of the first rotor located.

19 Claims, 15 Drawing Sheets

(51) Int. Cl.

| | |
|---|---|
| ***F04D 29/043*** | (2006.01) |
| ***F04D 29/12*** | (2006.01) |
| ***F04D 29/42*** | (2006.01) |

(56) References Cited

U.S. PATENT DOCUMENTS

| | | | | |
|---|---|---|---|---|
| 4,395,130 | A * | 7/1983 | Kutowy | B01F 5/106 241/46.17 |
| 4,941,801 | A * | 7/1990 | Takakura | F04D 13/14 415/170.1 |
| 5,558,502 | A * | 9/1996 | Fukazawa | F04D 29/669 417/36 |
| 6,142,744 | A * | 11/2000 | Taylor | F04D 13/14 417/286 |
| 6,960,069 | B2 * | 11/2005 | Maruta | F16D 31/02 417/199.1 |
| 8,123,458 | B2 * | 2/2012 | Racer | F04D 29/605 415/56.1 |
| 8,128,340 | B2 * | 3/2012 | Racer | F04D 9/04 415/56.1 |
| 9,982,896 | B2 | 5/2018 | Chen et al. | |
| 10,072,644 | B2 * | 9/2018 | Spybey | F04D 13/14 |
| 10,198,046 | B2 * | 2/2019 | Tsai | H05K 7/20272 |
| 10,670,002 | B2 * | 6/2020 | Van Keulen | B05B 12/1445 |
| 10,788,052 | B2 * | 9/2020 | Nuhn | F04D 29/628 |
| 2014/0271123 | A1 * | 9/2014 | Rosinski | F04D 13/14 415/60 |
| 2016/0338223 | A1 * | 11/2016 | Tsai | G06F 1/20 |
| 2017/0009773 | A1 * | 1/2017 | Marengo | F04D 1/06 |
| 2018/0087512 | A1 | 3/2018 | Darley | |
| 2018/0094633 | A1 * | 4/2018 | Huang | F04D 29/605 |
| 2019/0107122 | A1 * | 4/2019 | Shen | H05K 7/20272 |
| 2020/0208629 | A1 * | 7/2020 | Valkenberg | F01C 21/10 |
| 2021/0219466 | A1 * | 7/2021 | Kim | H05K 7/20872 |

FOREIGN PATENT DOCUMENTS

| | | | |
|---|---|---|---|
| CN | 109923315 | A | 6/2019 |
| TW | I602994 | B | 10/2017 |
| TW | M562420 | U | 6/2018 |

OTHER PUBLICATIONS

Office Action dated Nov. 29, 2021 of the corresponding China patent application No. 201910886114.3.

* cited by examiner

WATER PUMP MODULE

BACKGROUND OF THE INVENTION

Field of the Invention

The present invention generally relates to a water pump, and more particularly to a water pump module.

Description of Prior Art

Generally speaking, water pumps are used to increase the output pressure of a liquid to drive and transport the liquid. In addition, a traditional water pump uses a motor to drive a rotor, so that the pressure of water flow is increased when it passes through the rotor at a high speed of rotation and flows out along an outer edge of the blade under the action of centrifugal force. However, presently, the pressure of water flow increased by a single pump is limited. Thus, multiple pumps are often connected in series to achieve the required pump head or pressure when in use.

Moreover, pumps connected in series have been used for heat exchange modules of cooling systems. For example, U.S. Pat. No. 1,602,994 published in Taiwan, in which a first rotor chamber and a second rotor chamber are formed in a pump body. The first rotor chamber has a first outlet; the second rotor chamber has a second inlet; and a connection conduit is communicated between the first outlet and the second inlet. The first rotor is pivoted in the first rotor chamber, and the second rotor is pivoted in the second rotor chamber; therefore, the first rotor and the second rotor are disposed in series.

However, in the above U.S. Pat. No. 1,602,994, the working fluid must first enter the water collection chamber from the water inlet before flowing into the first rotor chamber. Through the connection conduit communicating with the second rotor chamber, the working fluid entering the second rotor chamber flows into a discharging chamber and finally flows out through the discharging hole. In the structure of above pumps in series, the path of the working fluid is long and has a large impedance of water. Thus, the working efficiency of the pumps in series is poor. Furthermore, as the two water pumps are arranged horizontally, the pumps in series have to occupy a larger area which may cause inconvenience.

In view of the above drawbacks, the Inventor proposes the present invention based on his expert knowledge and elaborate research in order to solve the problems of prior art.

SUMMARY OF THE INVENTION

Accordingly, an object of the present invention is to provide a water pump module for enhancing pump head and redundant functions, so that a water pump module with high performance is achieved.

Accordingly, another object of the present invention is to provide a water pump module to lower the impedance of water and reduce materials to simplify the manufacturing process, and the space utilization will be improved to reduce costs.

In order to achieve the object mentioned above, the present invention provides a water pump module including a pump body, a first pump and a second pump. The pump body includes a housing, a first chamber and a second chamber separated and communicated by the housing, an input pipe communicated with the first chamber and an output pipe communicated with the second chamber. The input pipe has a water outlet, and the water outlet is located on an inner wall of the first chamber. The output pipe has a water inlet, and the water inlet is located on an inner wall of the second chamber. The first pump has a first rotor, and the first rotor is placed in the first chamber. The second pump has a second rotor, and the second rotor is placed in the second chamber, wherein an extension line of a rotating shaft of the second rotor is perpendicular to a plane where a rotating shaft of the first rotor is located.

In order to achieve the object mentioned above, the present invention provides a water pump module including a pump body, a first pump and a second pump. The pump body includes a housing, a first chamber and a second chamber separated and communicated by the housing, an input pipe communicated with the first chamber, an output pipe communicated with the second chamber and a connection conduit located between the first chamber and the second chamber, wherein a first opening of the connection conduit is connected to the first chamber and a second opening of the connection conduit is connected to the second chamber, and a conduit main axis of the connection conduit passes through the first opening and the second opening. The first pump has a first rotor, and the first rotor is placed in the first chamber. The second pump has a second rotor, and the second rotor is placed in the second chamber.

In order to achieve the object mentioned above, the present invention provides a water pump module including a pump body, a first pump and a second pump. The pump body includes a housing, a first chamber and a second chamber separated and communicated by the housing, an input pipe communicated with the first chamber, an output pipe communicated with the second chamber and a connection conduit communicated with the first chamber and the second chamber, wherein a first opening of the connection conduit is connected to the first chamber and a second opening of the connection conduit is connected to the second chamber, and a partial of first chamber projection overlaps with a partial of second chamber projection. The first pump includes a first rotor placed in the first chamber, and the first rotor is disposed on a first shaft column axially. The second pump includes a second rotor placed in the second chamber, and the second rotor is disposed on a second shaft column axially.

Compared to the prior art, the water pump body of the water pump module of the present invention provides a first chamber and a second chamber in communication; additionally, the water outlet is arranged on the inner wall of the first chamber, and the water inlet is located on the inner wall of the second chamber. The first water pump and the second water pump are installed in the first chamber and the second chamber respectively to complete the connections of pipeline and pumps in series. Moreover, the first and the second water pumps of the present invention share an input pipe and an output pipe; therefore, the two water pumps do not need to dispose a water inlet and outlet separately. Thereby, the processes of cleaning, sealing, and installing of pipeline can be reduced. In addition, the water pump module of the present invention can further eliminate processes of disposing, connecting, and fixing of pipe clamps. Furthermore, since the input pipe connects the water chamber directly for shortening the flow path and simplifying structures, the impedance of water when the pipeline is connected or bent can be reduced. As a result, the water pressure and pump head can be increased to have advantages of standby (redundant), material reduction and cost reduction etc., and the practice of the present invention is enhanced.

BRIEF DESCRIPTION OF DRAWINGS

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE PREFERRED EMBODIMENTS

In cooperation with attached drawings, the technical contents and detailed description of the invention are described thereinafter according to a number of preferable embodiments, not being used to limit its executing scope. Any equivalent variation or modification made according to appended claims is all covered by the claims claimed by the present invention.

Figure 1:
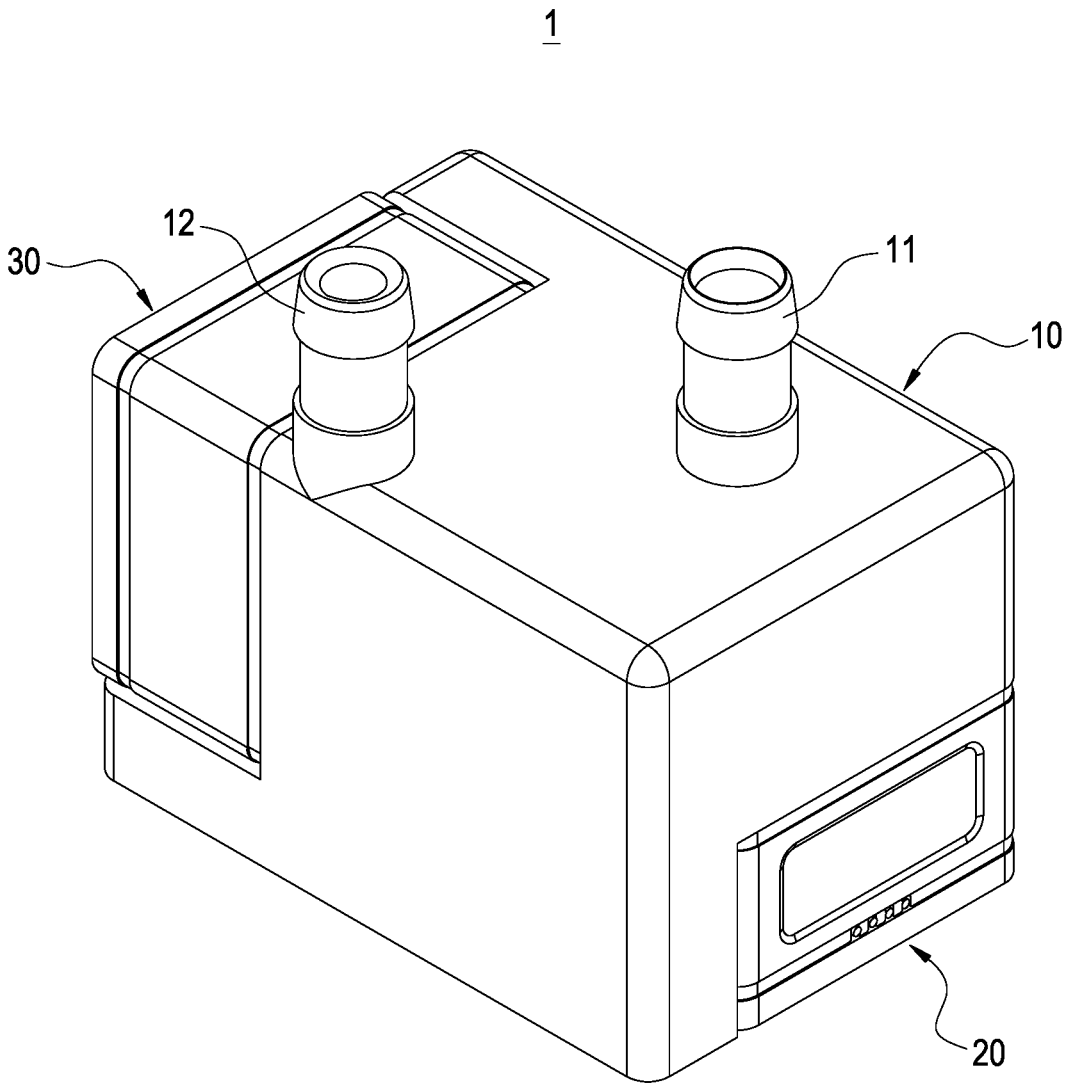
FIG. 1 is a perspective schematic view of the water pump module of the present invention.

Please refer to FIG. 1, which depicts a perspective schematic view of the water pump module of the present invention. The present invention is a water pump module 1 including a pump body 10, a first pump 20 and a second pump 30. The pump body 10 has an input pipe 11 and an output pipe 12. The first pump 20 and the second pump 30 are installed in the pump body 10 to constitute the water pump module 1. In addition, in the present embodiment, the input pipe 11 and the output pipe 12 are parallelly disposed and located on the same side of the pump body 10 as an example for description. However, the input pipe 11 and the output pipe 12 can be arranged on different sides if needed.

Please further refer to FIG. 2 to FIG. 5, which depict a cross sectional view of the water pump module of the present invention, a perspective explosion schematic view of the water pump module of the present invention, a cross sectional view of the first chamber and a cross sectional view of the second chamber of the present invention. Please refer to FIG. 2 and FIG. 3. The first pump 20 has a first casing 22 and a first rotor 21 disposed on the first casing 22. The second pump 30 has a second casing 32 and a second rotor 31 disposed on the second casing 32. The pump body 10 can be divided into a housing 13, an input pipe 11 and an output pipe 12.

Specifically, a rotating shaft 311 of the second rotor 31 has an extension line 310. The extension line 310 is perpendicular to a rotating shaft 211 of the first rotor 21. Preferably, the extension line 310 of the second rotor 31 is perpendicular to the rotating shaft 211 of the first rotor 21 without intersecting. Similarly, a rotating shaft 211 of the first rotor 21 has an extension line 210. The extension line 210 is perpendicular to a rotating shaft 311 of the second rotor 31. In the present embodiment, an axis plane 200 where the rotating shaft 211 of the first rotor 21 located is parallel to a top plane 301 of the second rotor 31. The extension line 310 of the second rotor 31 is substantially perpendicular to the axis plane 200 rather than directly intersecting the rotating shaft 211 of the first rotor 21.

The first casing 22 and the housing 13 are combined to constitute the first chamber 14. In addition, the second casing 32 and the housing 13 are combined to constitute the second chamber 15. The first chamber 14 and the second chamber 15 are disposed at two sides of the housing 13 and are separated and communicated by the housing 13. The first chamber 14 and the second chamber 15 are separated with each other. Furthermore, the water outlet 110 of the input pipe 11 is communicated with the first chamber 14, and the water inlet 120 of the output pipe 12 is communicated with the second chamber 15.

Moreover, after the first pump 20 is assembled with the water pump body 10, the first rotor 21 is placed in the first chamber 14. After the second pump 30 is assembled with the water pump body 10, the second rotor 31 is placed in the second chamber 15.

Figure 4:
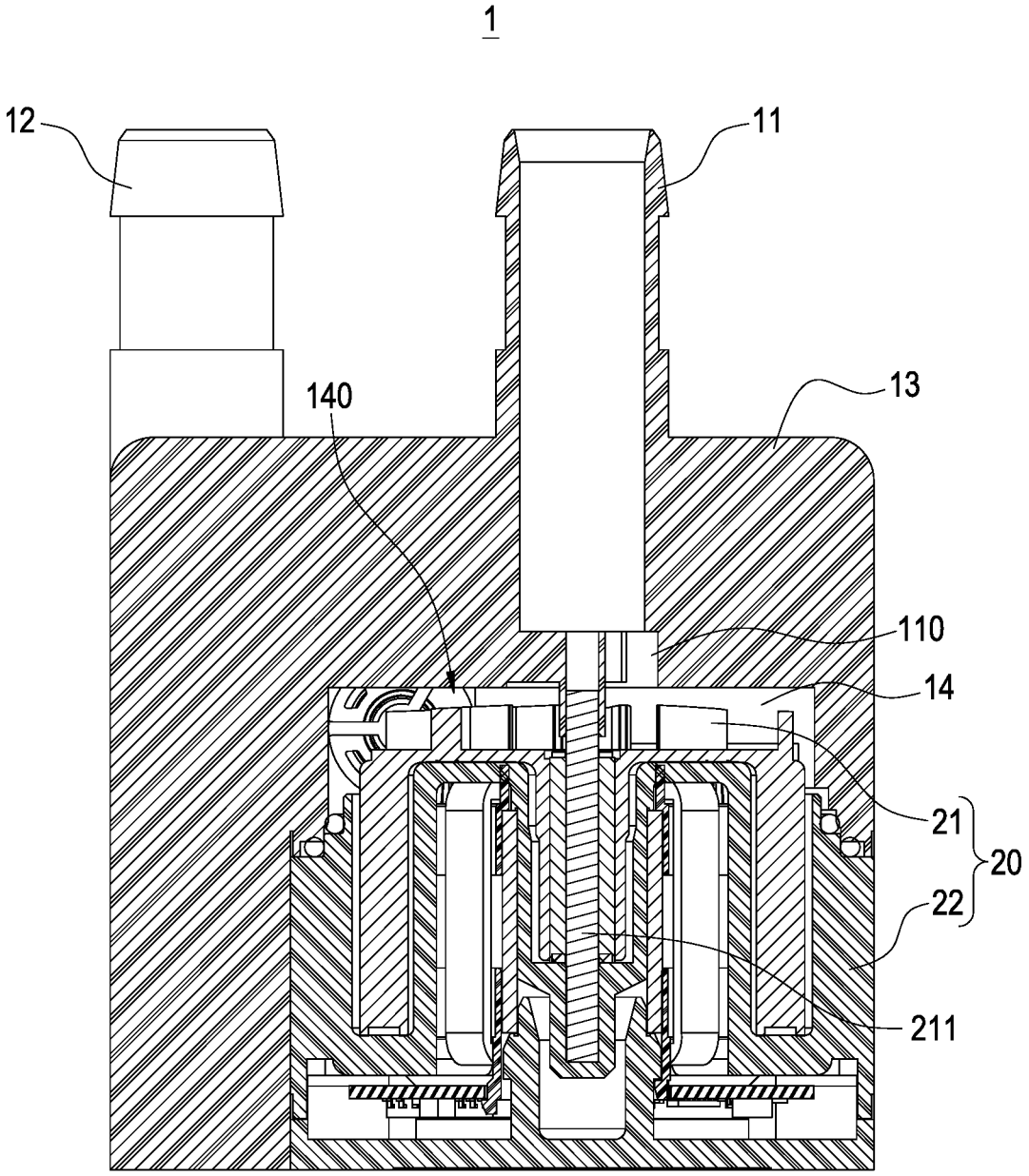
FIG. 4 is a cross sectional view of the first chamber of the present invention.

In more detail, as shown in FIG. 4, the water outlet 110 is located on an inner wall 140 of the first chamber 14. It is worth noticing that, in the present embodiment, an axis of the rotating shaft 211 of the first rotator 21 is preferably extended into the water outlet 110.

Figure 5:
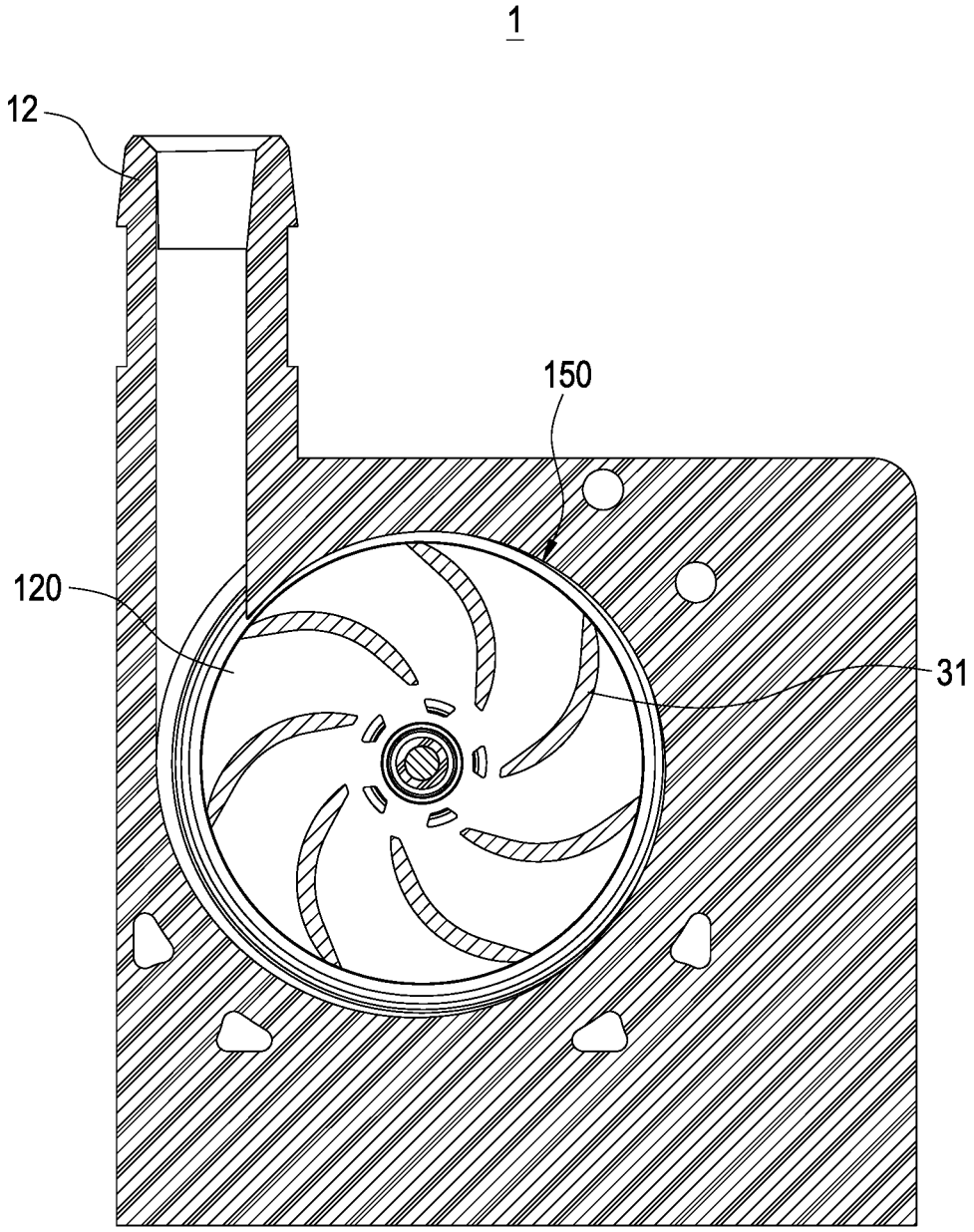
FIG. 5 is a cross sectional view of the second chamber of the present invention.

Furthermore, as shown in FIG. 5, the water inlet 120 is located on an inner wall 150 of the second chamber 15. It is worth noticing that, the water inlet 120 is located in a radial direction of the second rotor 31.

Figure 2:
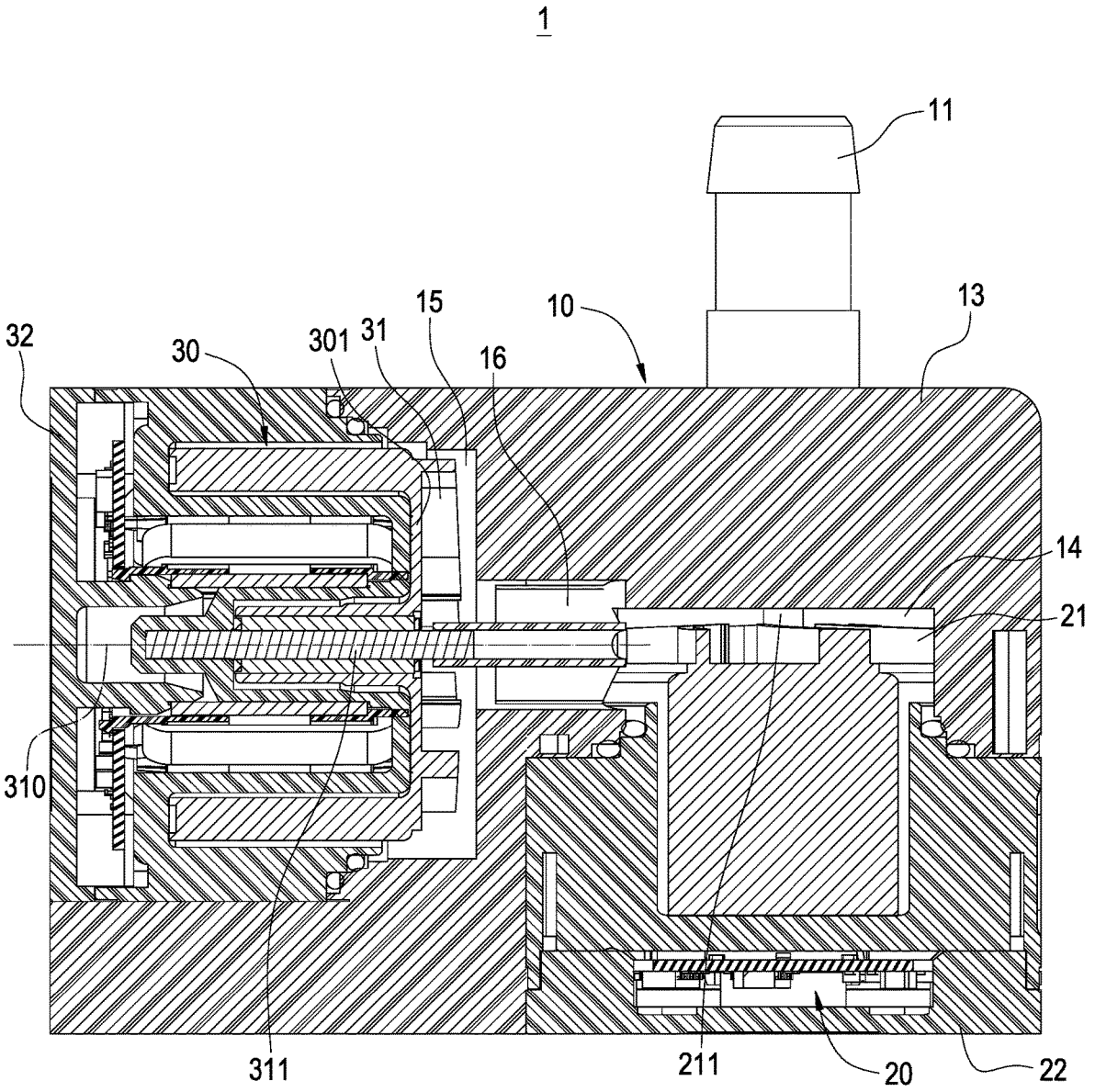
FIG. 2 is a cross sectional view of the water pump module of the present invention.
Figure 3:
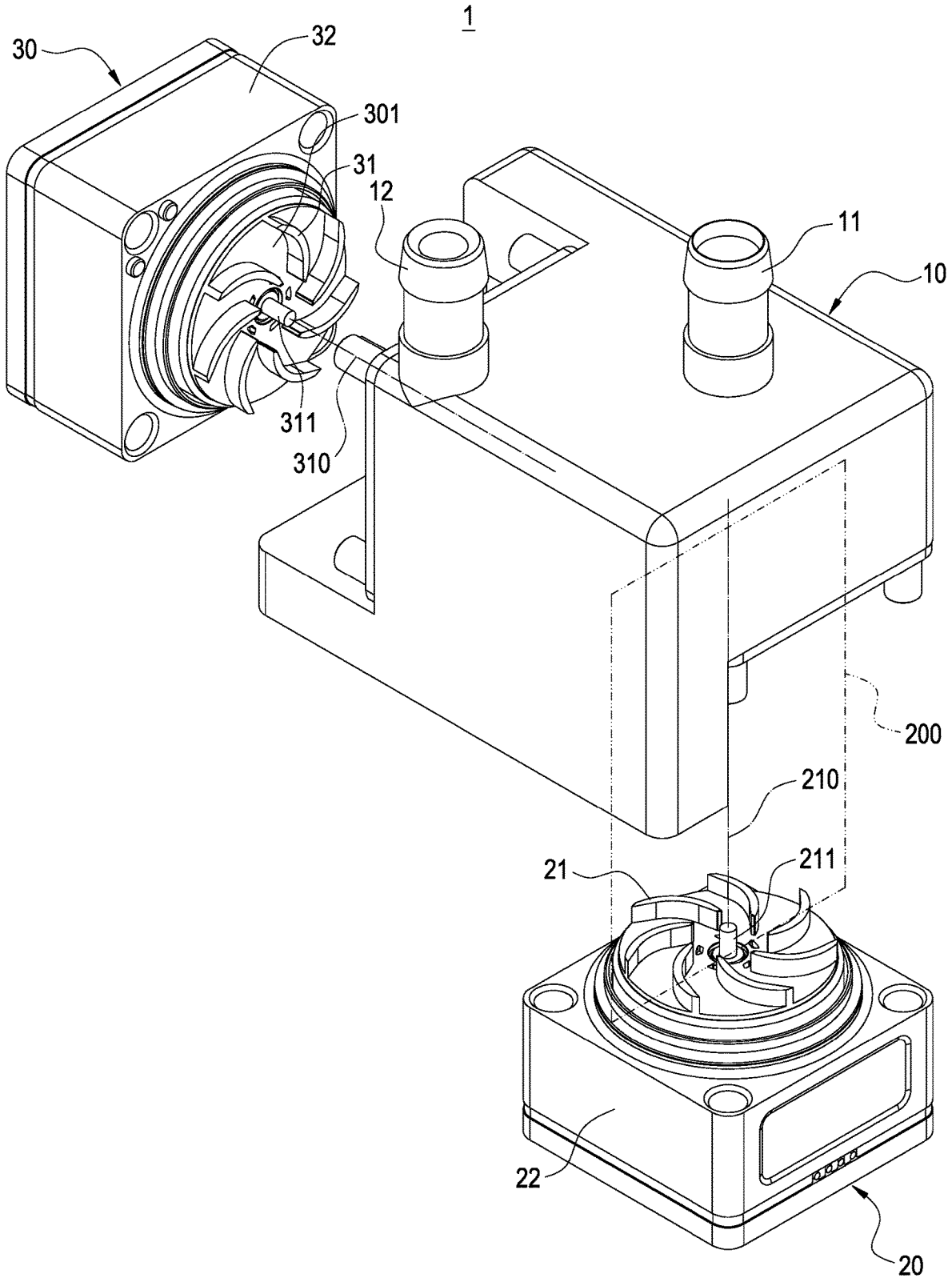
FIG. 3 is a perspective explosion schematic view of the water pump module of the present invention.
Figure 6:
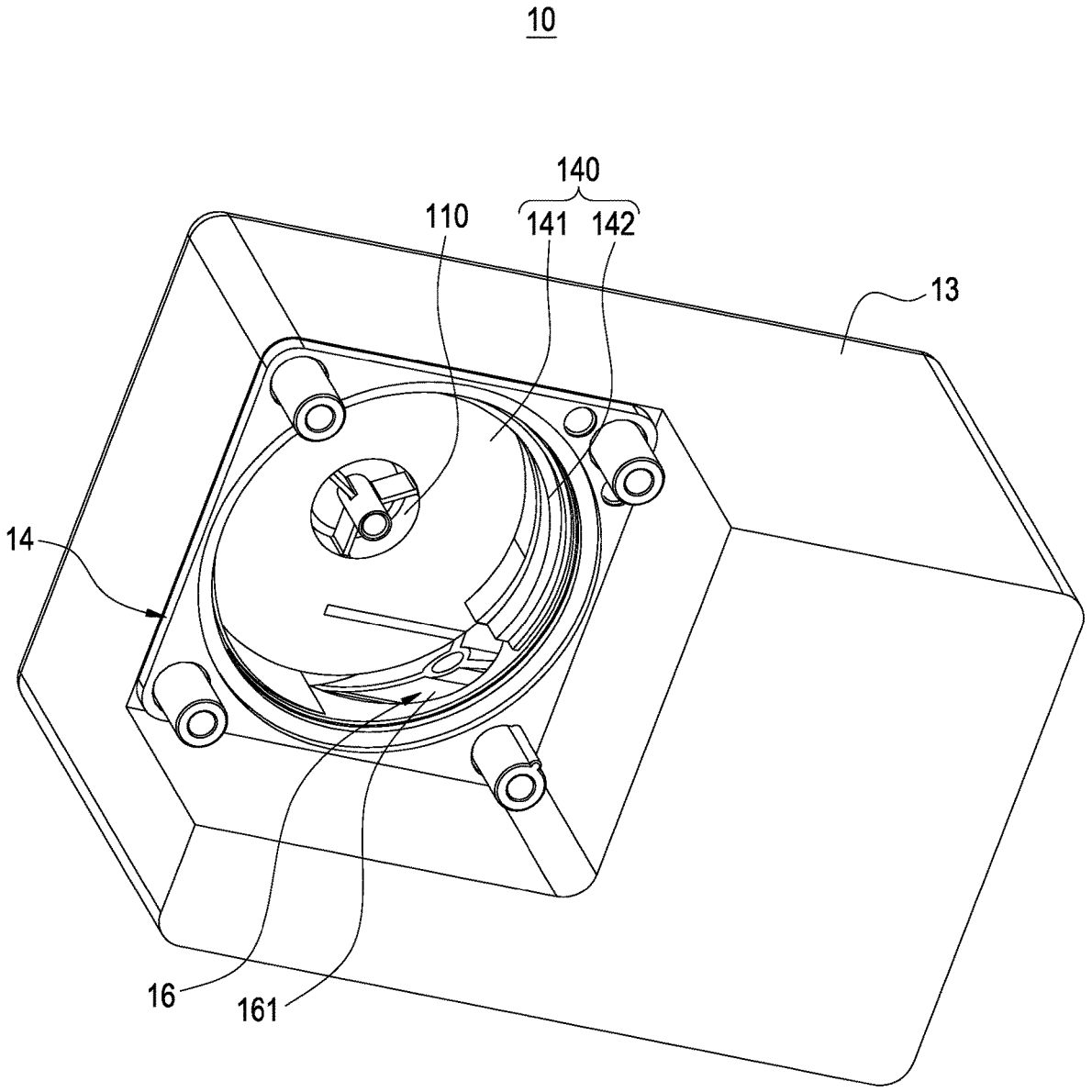
FIG. 6 and FIG. 7 are perspective schematic views of the pump body of FIG. 2 of the present invention.
Figure 7:
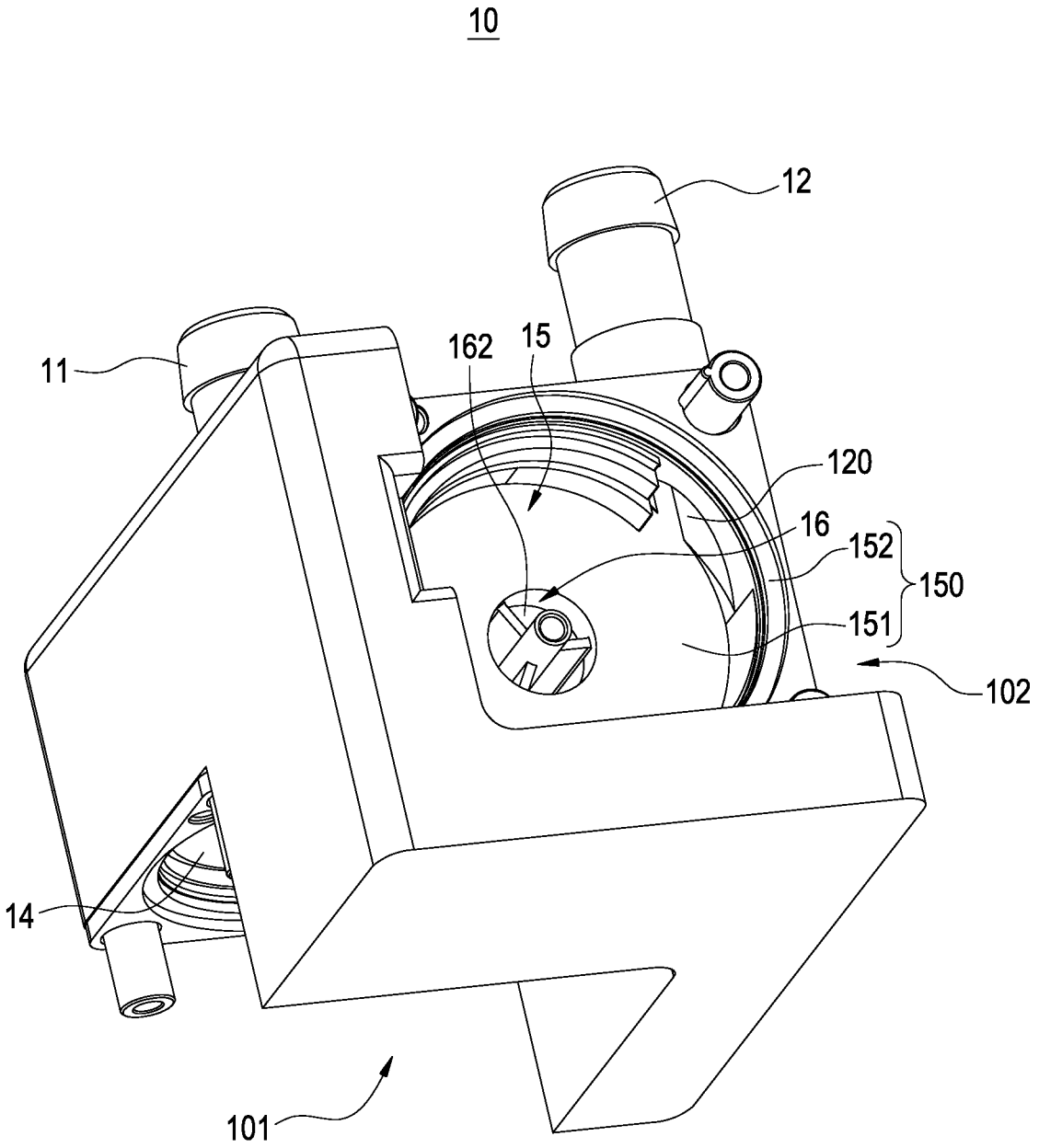

Please refer to FIG. 6 and FIG. 7, which depict perspective schematic views of the water pump body of FIG. 2 in opposite directions. As shown in FIG. 6, the housing 13 has a connection conduit 16 for communicating the first chamber 14 and the second chamber 15. One end of the connection conduit 16 is a first opening 161, and another end is a second opening 162. The inner wall 140 of the first chamber 14 includes a first inner bottom 141 and a first inner side wall 142 surrounding the first inner bottom 141, wherein the water outlet 110 is located at the first inner bottom 141 of the first chamber 14, and the first opening 161 of the connection conduit 16 is located at the first inner side wall 142.

Moreover, as shown in FIG. 7, the inner wall 150 of the second chamber 15 includes a second inner bottom 151 and a second inner side wall 152 surrounding the second inner bottom 151, wherein the water inlet 120 is located at the inner wall (the second inner side wall 152) of the second chamber 15. In one embodiment of the present invention, the plane where the second inner bottom 151 is located is not parallel to the plane where the first inner bottom 141 located; preferably, the plane where the second inner bottom 151 located is perpendicular to and intersects with the plane where the first inner bottom 141 located.

The first opening 161 (inlet) of the connection conduit 16 is connected to the first chamber 14, and the second opening 162 (outlet) of another end of the connection conduit 16 is connected to the second chamber 15. In addition, the conduit main axis of the connection conduit 16 passes through the first opening 161 and second opening 162. It is worth noticing that, the conduit main axis of the connection conduit 16 is formed by a link of a center of each cross section in the extension direction of the connection conduit 16, wherein the conduit main axis is preferably extended linearly.

More specifically, the first opening 161 of the connection conduit 16 faces away from the rotating shaft 211 of the first rotor 21, and the second opening 162 of the connection conduit 16 is adjacent to the rotating shaft 311 of the second rotor 31. Furthermore, the water inlet 120 faces away from the rotating shaft 311 of the second rotor 31. Although the output pipe 12 and the input pipe 11 are extended from the same side of the pump body 10, they are not limited thereto. The output pipe 12 and the input pipe 11 can be extended and protruded from different sides of the pump body 10 if needed. In addition, the input pipe 11 or the output pipe 12 can be flat pipes.

Figure 8:
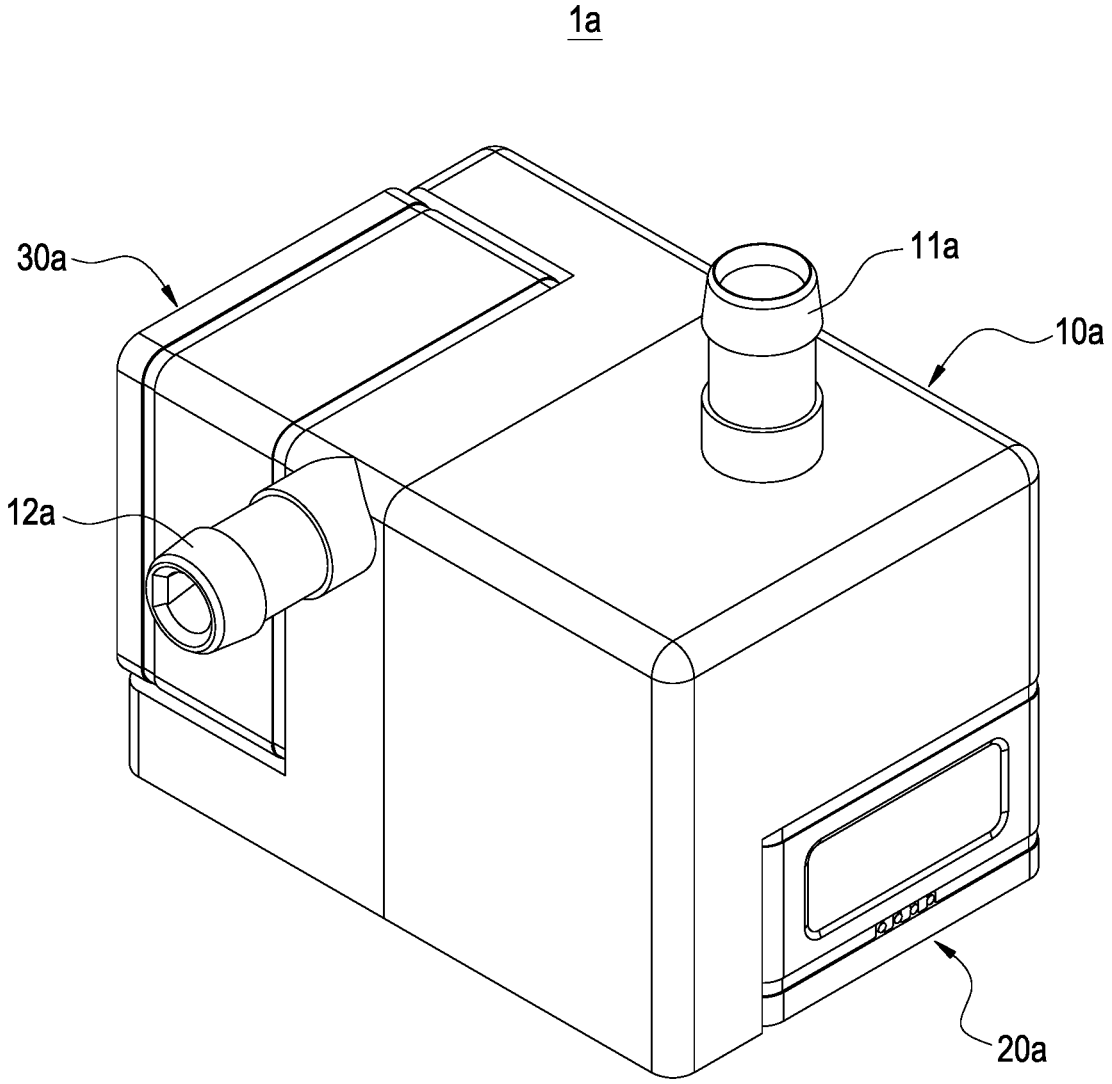
FIG. 8 is another embodiment of the water pump module of the present invention.

Please refer to FIG. 8, which depicts another embodiment of the water pump module of the present invention. The present embodiment is substantially the same as the previous embodiment. A water pump module 1*a* includes a pump body 10*a*, a first pump 20*a* and a second pump 30*a*. The pump body 10*a* has an input pipe 11*a* and an output pipe 12*a*, and the first pump 20*a* and the second pump 30*a* are installed in the pump body 10*a*. The present embodiment is different from the previous embodiment in that the input pipe 11*a* and the output pipe 12*a* are disposed on different sides of the pump body 10*a*. The planes where the extension lines of the input pipe 11*a* and output pipe 12*a* located are preferably perpendicular.

Figure 9:
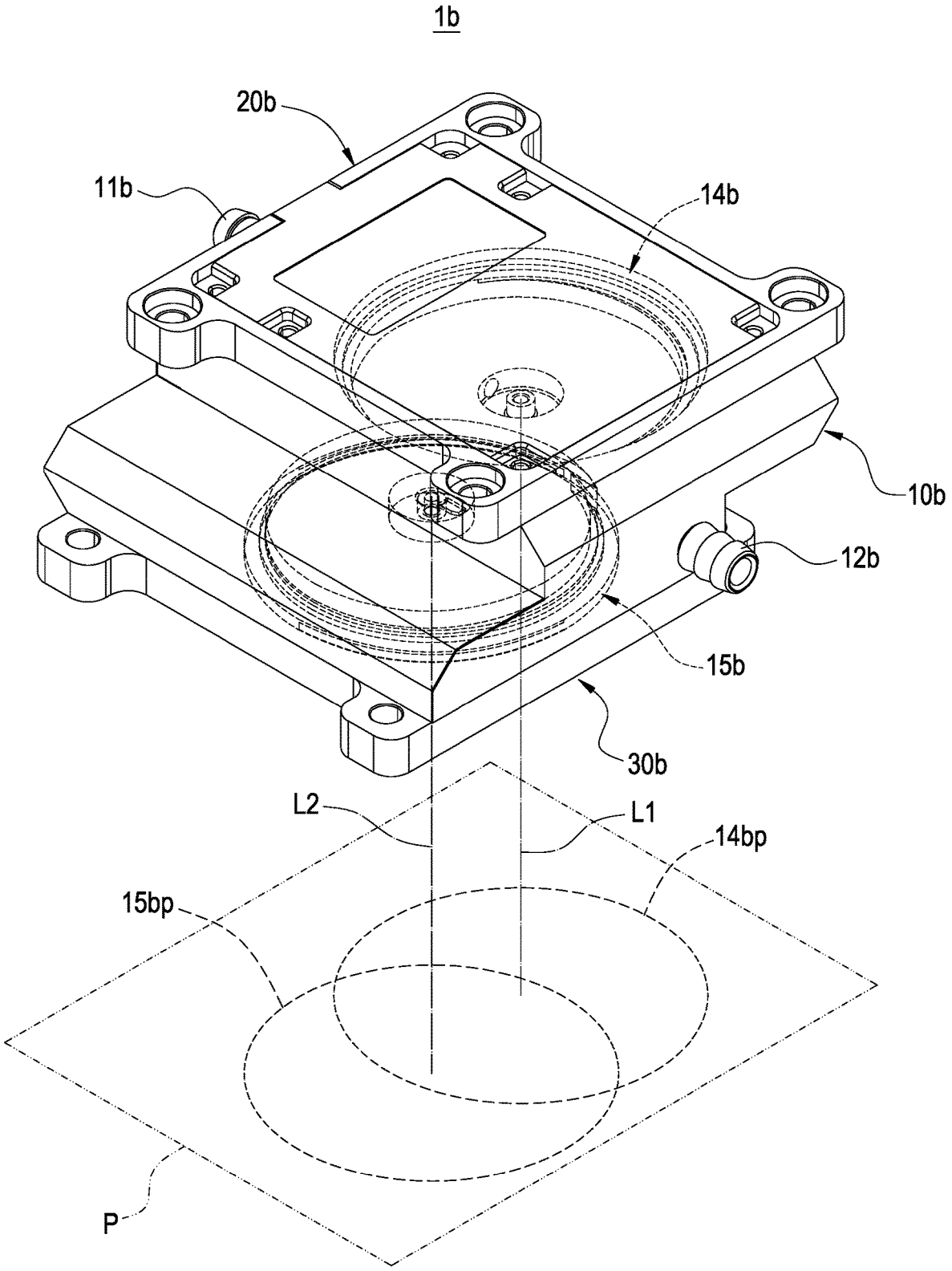
FIG. 9 is a perspective and projection schematic view of another embodiment of the water pump module of the present invention.

Please further refer to FIG. 9, which depicts a perspective and projection schematic view of another embodiment of the water pump module of the present invention. In the present embodiment, a water pump module 1*b* includes a pump body 10*b*, a first pump 20*b* and a second pump 30*b*. The pump body 10*b* has an input pipe 11*b* and an output pipe 12*b*. The first pump 20*b* and the second pump 30*b* are installed in the pump body 10*b*.

Please refer to FIG. 10 to FIG. 13, which depict a top view of the water pump module of FIG. 9, a perspective explosion schematic view of the water pump module of FIG. 9 and two perspective schematic views of the water pump module of FIG. 9 in opposite directions. FIG. 14A and FIG. 14B are two cross sectional views of the water pump module of FIG. 9 of the present invention. Please also refer to FIG. 11 to FIG. 14B. The first pump 20*b* has a first casing 22*b* and a first rotor 21*b* disposed on the first casing 22*b*. The second pump 30*b* has a second casing 32*b* and a second rotor 31*b* disposed on the second casing 32*b*. The pump body 10*b* can be divided into a housing 13*b*, an input pipe 11*b* and an output pipe 12*b*. The second casing 32*b* is attached to another side of the water pump body 10*b* corresponding to the first casing 22*b*.

The first casing 22*b* and the housing 13*b* are combined to constitute the first chamber 14*b*. In addition, the second casing 32*b* and the housing 13*b* are combined to constitute the second chamber 15*b*. The first chamber 14*b* and the second chamber 15*b* are located at two sides of the housing 13*b* and are separated and communicated by the housing 13*b*. Moreover, a water outlet 110*b* of the input pipe 12*b* is communicated with the first chamber 14*b*, and a water inlet 120*b* of output pipe 12*b* is communicated with the second chamber 15*b*.

Furthermore, after the first water pump 20*b* is assembled with the water pump body 10*b*, the first rotor 21*b* is placed in the first chamber 14*b*. After the second water pump 30*b* is assembled with the water pump body 10*b*, the second rotor 31*b* is placed in the second chamber 15*b*. The housing 13*b* is formed with a connection conduit 16*b* communicated with the first chamber 14*b* and the second chamber 15*b*.

Figure 10:
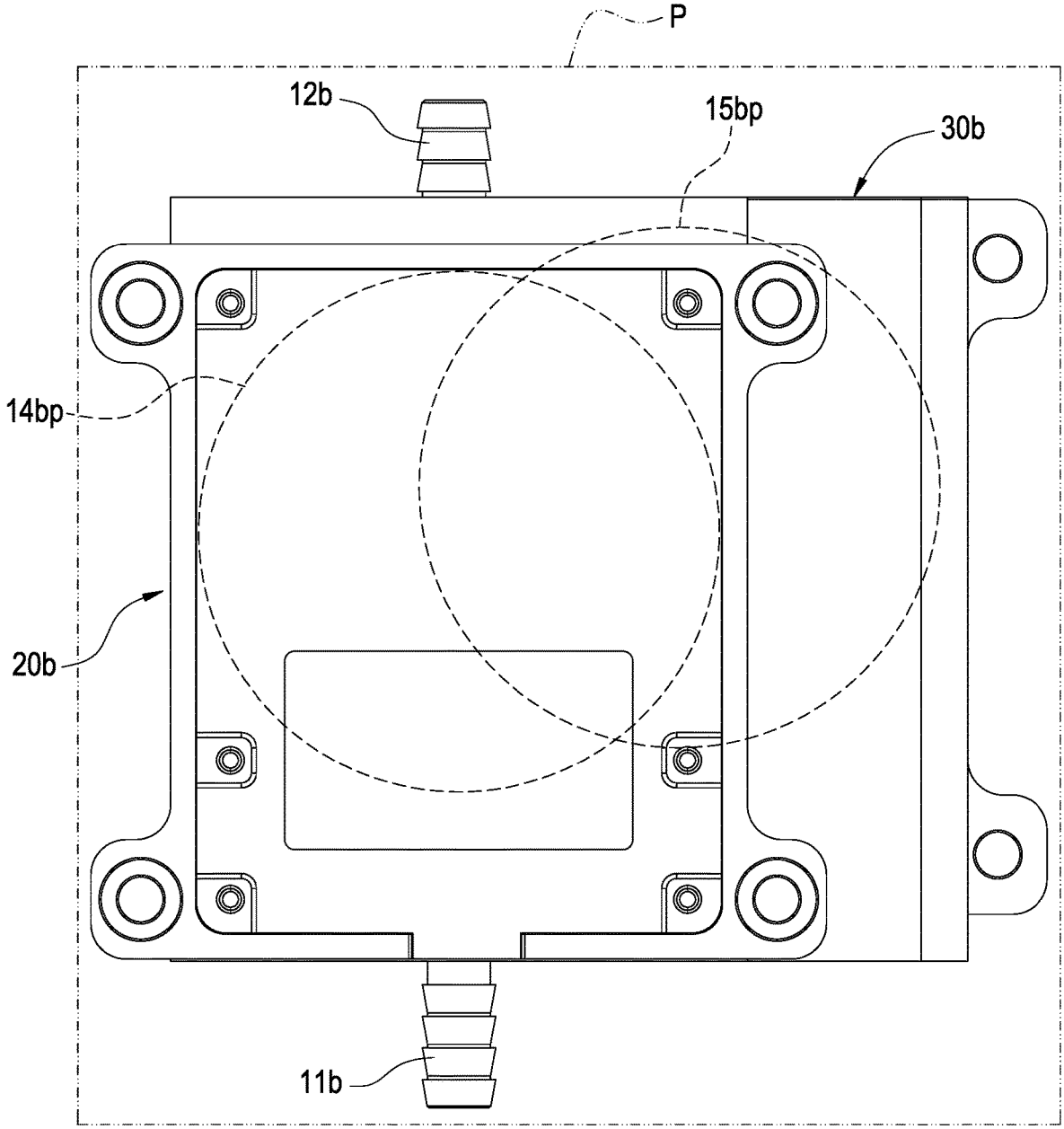
FIG. 10 is a top view of water pump module of FIG. 9 of the present invention.
Figure 11:
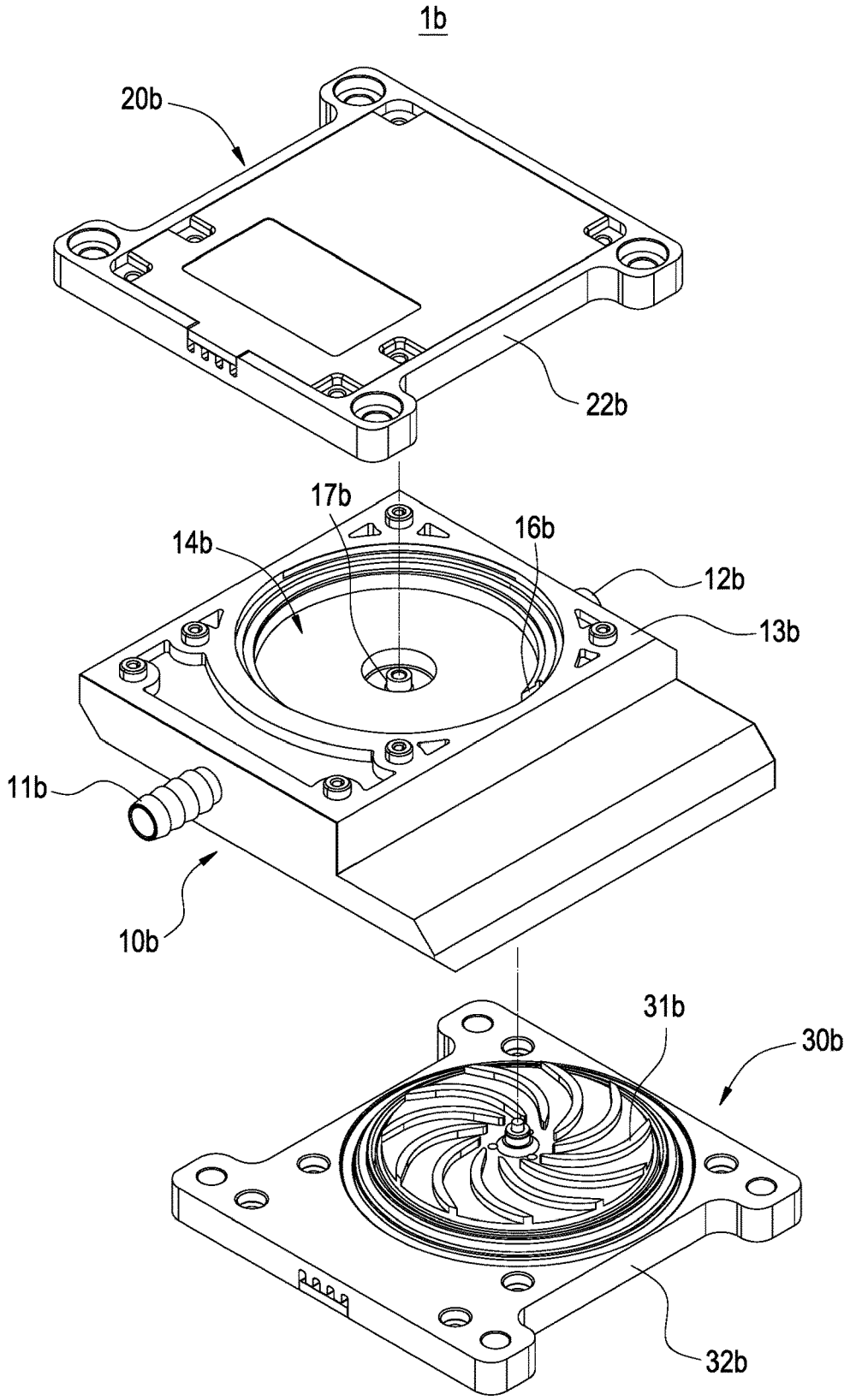
FIG. 11 is a perspective explosion schematic view of the water pump module of FIG. 9 of the present invention.

As shown in FIG. 9 and FIG. 10, a partial of first chamber projection 14*bp* overlaps with a partial of second chamber projection 15*bp*. More specifically, when the first chamber projection 14*bp* and the second chamber projection 15*bp* are on the same plane P, the first chamber projection 14*bp* and the second chamber projection 15*bp* will be partially overlapped. The first chamber projection 14*bp* refers to the first chamber 14*b* projected on the plane P which is perpendicular to the extension direction of the axis L1 of the first rotor 21*b*. The second chamber projection 15*bp* refers to the second chamber 15*b* projected on the plane P which is perpendicular to the extension direction of the axis L2 of the second rotor 21*b*.

Figure 12:
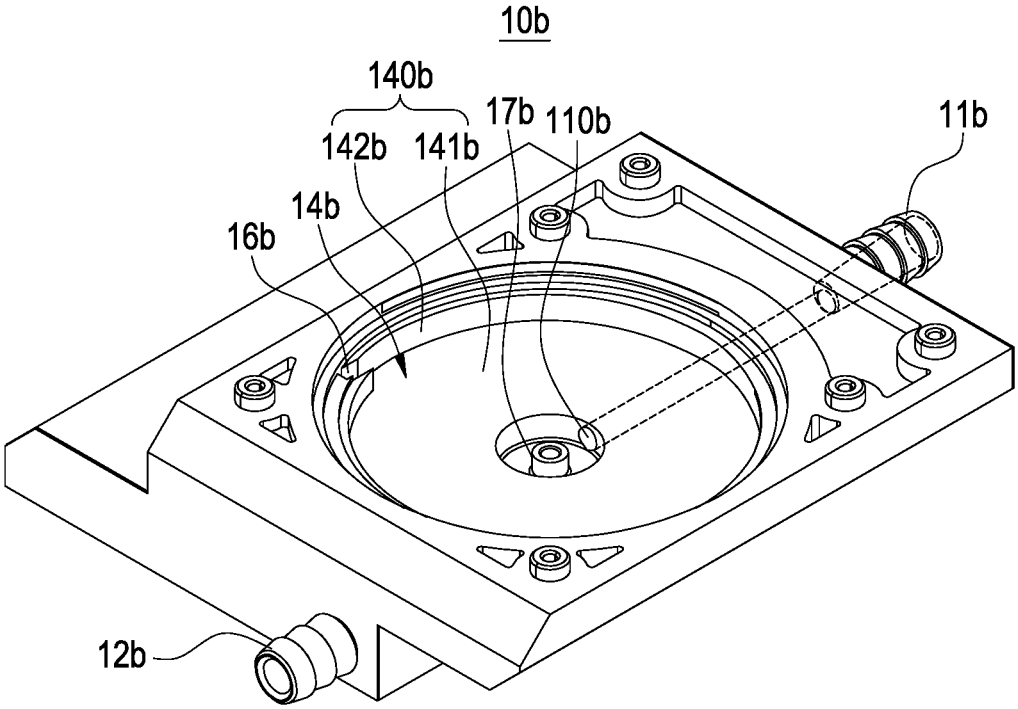
FIG. 12 and FIG. 13 are perspective schematic views of the water pump module of FIG. 9 of the present invention.

Moreover, as shown in FIG. 12, a first shaft column 17*b* is arranged at the water outlet 110*b* of the input pipe 11*b*. The inner wall 140*b* of the first chamber 14*b* includes a first inner bottom 141*b* and a first inner side wall 142*b* surrounding the first inner bottom 141*b*. The water outlet 110*b* is located on the first inner bottom 141*b*. The axis of the input pipe 11*b* can be located between the first chamber 14*b* and the second chamber 15*b*.

Figure 13:
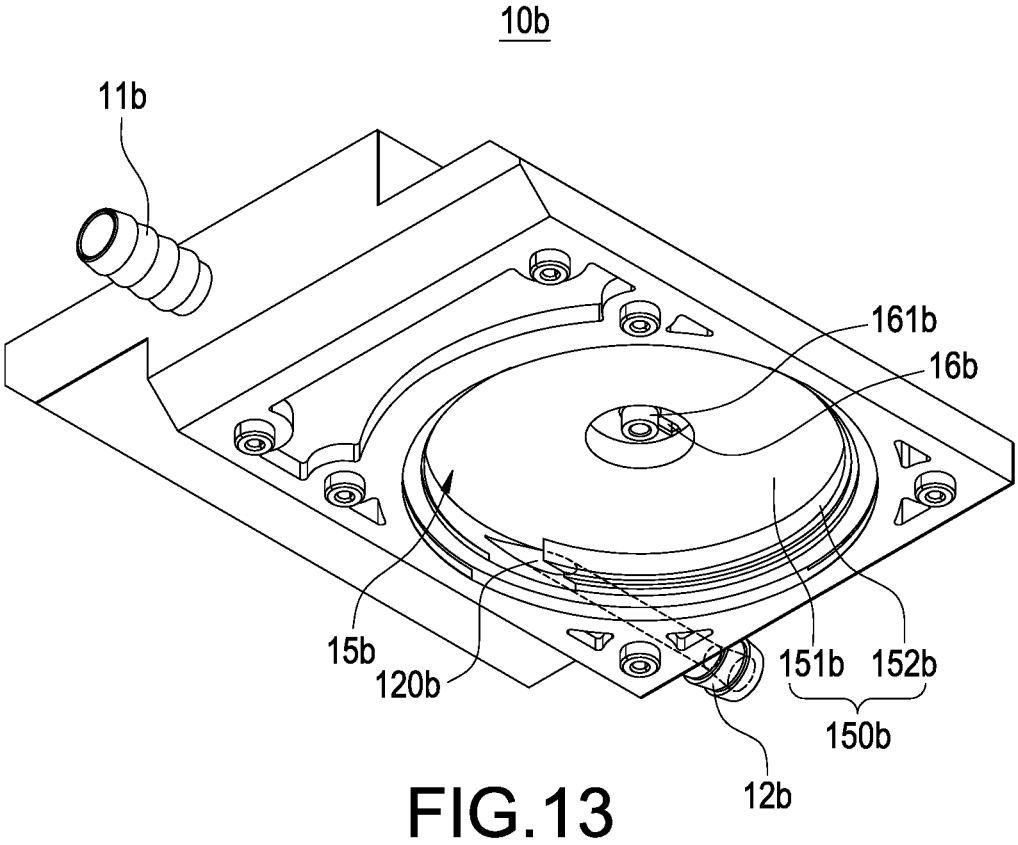
Figure 14A:
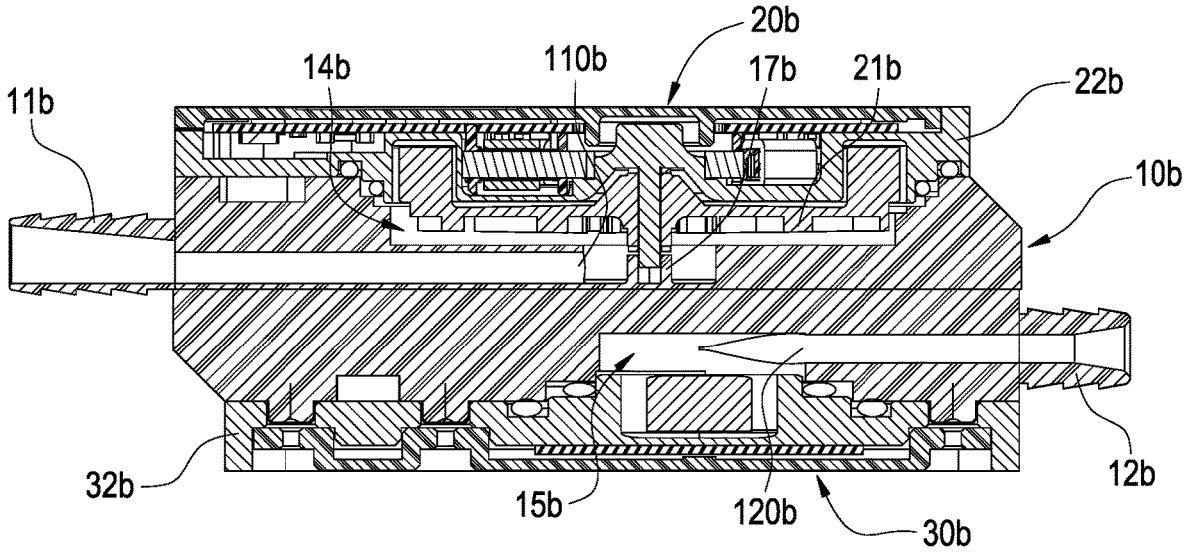
FIG. 14A and FIG. 14B are two cross sectional views of the water pump module of FIG. 9 of the present invention.
Figure 14B:
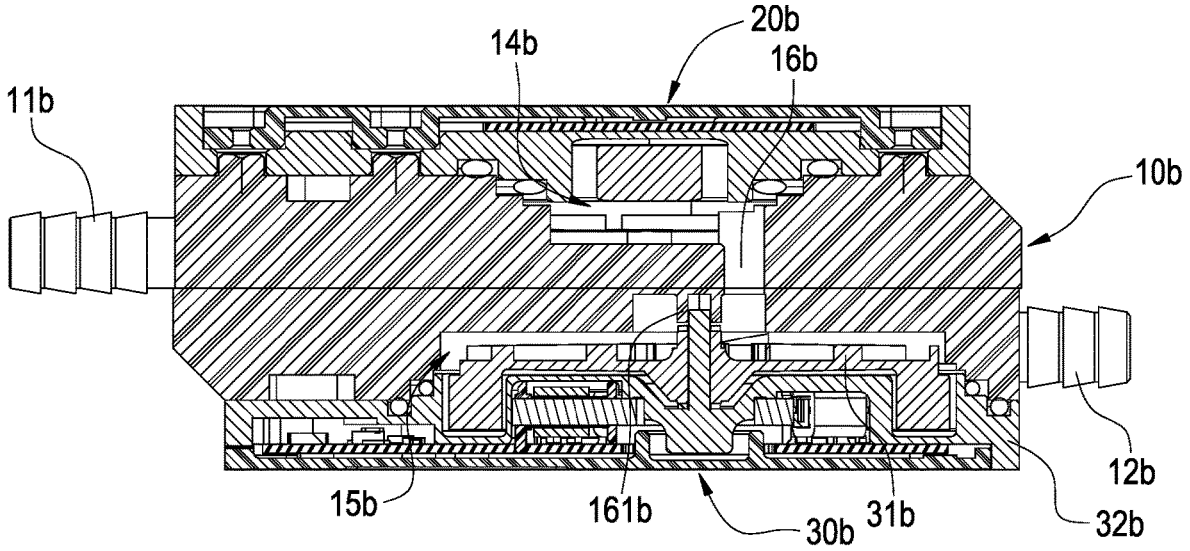

As shown in FIG. 13, the output pipe 12*b* has a water inlet 120*b*, and the water inlet 120*b* is located on an inner wall 150*b* of the second chamber 15*b*. Furthermore, a second shaft column 161*b* is disposed in the connection conduit 16*b*. In addition, the inner wall 150*b* of the second chamber 15*b* includes a second inner bottom 151*b* and a second inner side wall 152*b* surrounding the second inner bottom 151*b*, wherein, the inlet of the connection conduit 16*b* is located on the first inner side wall 142*b* or the first inner bottom 141*b* adjacent to the first inner side wall 142*b*. The outlet of the connection conduit 16*b* is located on the second inner bottom 151*b*. In one embodiment of the present invention, the water inlet 120*b* is located at the inner wall 150*b* (the second inner side wall 152*b*) of the second chamber 15*b*. Furthermore, please refer to FIG. 14A and FIG. 14B. The first rotor 21*b* is disposed on the first shaft column 17*b* axially, and the second rotor 31*b* is disposed on the second shaft column 161*b* axially.

Figure 15:
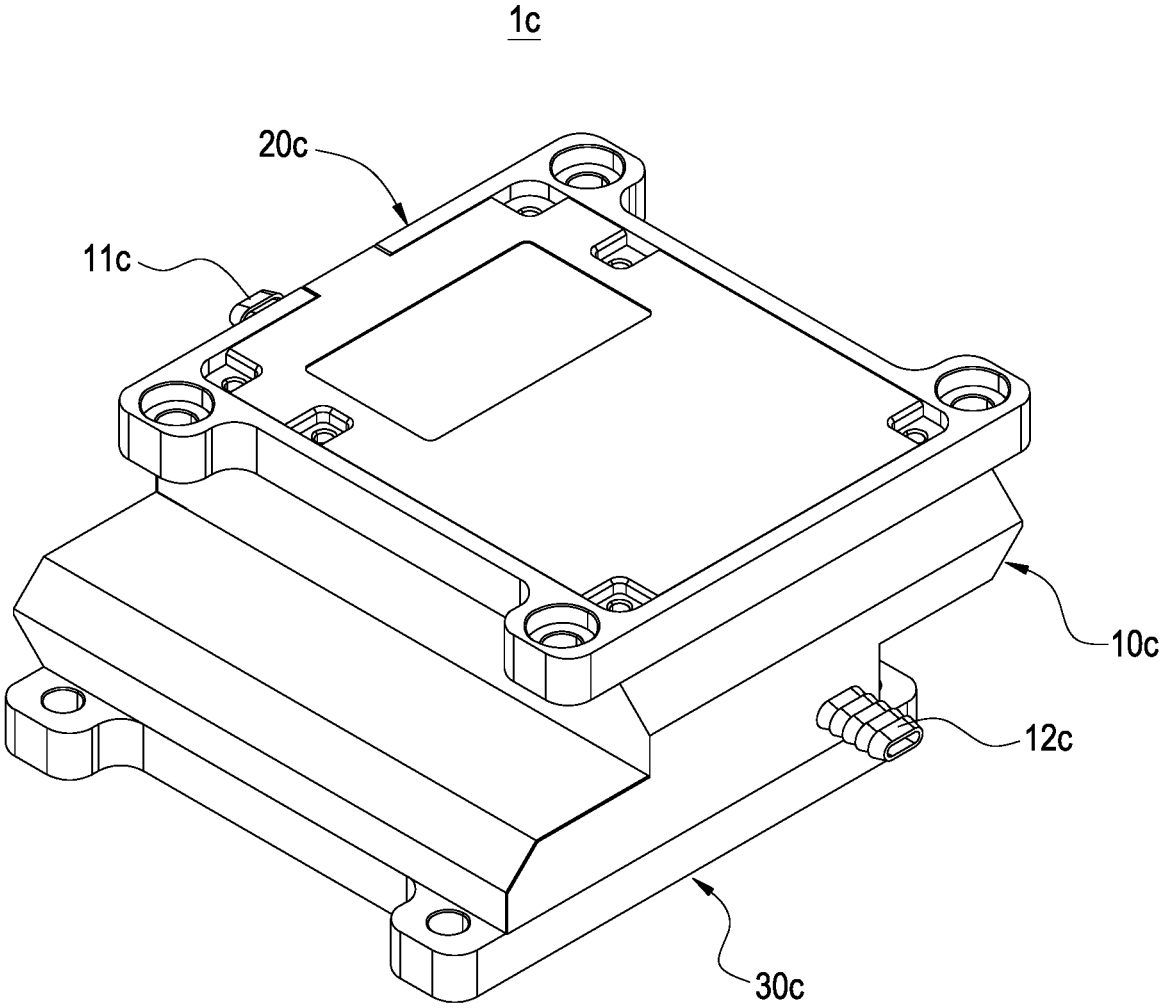
FIG. 15 is another embodiment of the input pipe and the output pipe of the present invention.

Please further refer to FIG. 15, which depicts another embodiment of the input pipe and the output pipe of the present invention. The present embodiment is substantially the same as the embodiment shown in FIG. 9, a water pump module 1*c* includes pump body 10*c* a first pump 20*c* and a second pump 30*c*. In addition, the pump body 10*c* has an input pipe 11*c* and an output pipe 12*c*. The difference between the present embodiment and the embodiment shown in FIG. 9 is the appearances of the input pipe 11*c* and the output pipe 12*c*. In the present embodiment, the input pipe 11*c* or the output pipe 12*c* are flat pipes. It is worth noticing that, the input pipe 11*c* or the output pipe 12*c* are flat pipes for increasing the water output and the water pressure; thereby, the working performance of the water pump module 1*c* will be improved.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A water pump module, comprising:

a pump body including a housing, a first chamber and a second chamber separated and communicated by the housing, an input pipe communicated with the first chamber and an output pipe communicated with the second chamber; the input pipe having an outlet, and the outlet located on an inner wall of the first chamber; and the output pipe having an inlet, and the inlet located on an inner wall of the second chamber;

a first pump having a first rotor, and the first rotor being placed in the first chamber; and a second pump having a second rotor, and the second rotor being placed in the second chamber, wherein two extension lines of rotating shafts of the first rotor and the second rotor respectively lie in two planes that are perpendicular to each other while the two extension lines are offset from each other as viewed in either plane;

wherein the housing has a connection conduit, and the first chamber and the second chamber are isolated and communicated through the connection conduit, and wherein the first chamber and the second chamber are located on different sides of the housing.

2. The water pump module according to claim 1, wherein the first pump has a first casing, and the first casing and the housing are combined to constitute the first chamber; and the second pump has a second casing, and the second casing and the housing are combined to constitute the second chamber.

3. The water pump module according to claim 1, wherein an extension line of the rotating shaft of the first rotor is extended into the outlet.

4. The water pump module according to claim 1, wherein the inlet is located in a radial direction of the second rotor.

5. The water pump module according to claim 1, wherein a first opening of one end of the connection conduit is connected to the first chamber and a second opening of another end of the connection conduit is connected to the second chamber; and a conduit main axis of the connection conduit passes through the first opening and the second opening.

6. The water pump module according to claim 1, wherein the output pipe and the input pipe are extended and protruded from different sides of the pump body.

7. The water pump module according to claim 1, wherein the input pipe or the output pipe are flat pipes.

8. A water pump module, comprising:

a pump body including a housing, a first chamber, a second chamber, an input pipe communicated with the first chamber, an output pipe communicated with the second chamber and a connection conduit located between the first chamber and the second chamber, wherein the first chamber and the second chamber are separated with each other, and a first opening of the connection conduit is connected to the first chamber and a second opening of the connection conduit is connected to the second chamber, and a conduit main axis of the connection conduit passes through the first opening and the a first pump having a first rotor, and the first rotor being placed in the first chamber; and a second pump having a second rotor, and the second rotor being placed in the second chamber, wherein two extension lines of rotating shafts of the first rotor and the second rotor respectively lie in two planes that are perpendicular to each other while the two extension lines are offset from each other as viewed in either plane;

wherein the first chamber and the second chamber are isolated and communicated through the connection conduit, and the first chamber and the second chamber are located on different sides of the housing.

9. The water pump module according to claim 8, wherein the first opening of the connection conduit faces away from a rotating shaft of the first rotor; and the second opening of the connection conduit is adjacent to a rotating shaft of the second rotor.

10. The water pump module according to claim 9, wherein the output pipe has an inlet, and the inlet faces away from the rotating shaft of the second rotor.

11. The water pump module according to claim 8, wherein the first pump has a first casing, and the first casing is attached to a side of the water pump body; and the second pump has a second casing, and the second casing is attached to another side of the water pump body corresponding to the first casing.

12. The water pump module according to claim 8, wherein the input pipe or the output pipe are flat pipes.

13. A water pump module, comprising:

a pump body including a housing, a first chamber, a second chamber, an input pipe communicated with the first chamber, an output pipe communicated with the second chamber and a connection conduit connected with the first chamber and the second chamber, wherein the first chamber and the second chamber are separated with each other, and a first opening of the connection conduit is connected to the first chamber and a second opening of the connection conduit is connected to the second chamber, and a partial of first chamber projection overlaps with a partial of second chamber projection;

a first pump including a first rotor placed in the first chamber, and the first rotor being disposed on a first shaft column axially; and a second pump including a second rotor placed in the second chamber, and the second rotor being disposed on a second shaft column axially;

wherein the first chamber and the second chamber are isolated and communicated through the connection conduit, and the first chamber and the second chamber are located on different sides of the housing, wherein two extension lines of rotating shafts of the first rotor and the second rotor respectively lie in two planes that are perpendicular to each other while the two extension lines are offset from each other as viewed in either plane.

14. The water pump module according to claim 13, wherein the input pipe or the output pipe are flat pipes.

15. The water pump module according to claim 13, wherein the first opening of the connection conduit faces away from a rotating shaft of the first rotor; and the second opening of the connection conduit is adjacent to a rotating shaft of the second rotor.

16. The water pump module according to claim 15, wherein the output pipe has an inlet, and the inlet faces away from the rotating shaft of the second rotor.

17. The water pump module according to claim 13, wherein the input pipe has an outlet, and the outlet is located on an inner wall of the first chamber.

18. The water pump module according to claim 13, wherein a conduit main axis of the connection conduit passes through the first opening and the second opening.

19. The water pump module according to claim 13, wherein the first shaft column is arranged at the outlet of the input pipe, and the second shaft column is-adjacent to the connection conduit.

* * * * *